US008256039B2

(12) United States Patent
Morotomi et al.

(10) Patent No.: US 8,256,039 B2
(45) Date of Patent: Sep. 4, 2012

(54) SANITARY WASHING DEVICE

(75) Inventors: Yo Morotomi, Fukuoka-ken (JP); Ayumu Umemoto, Fukuoka-ken (JP); Koichiro Matsushita, Fukuoka-ken (JP)

(73) Assignee: Toto Ltd, Fukuoka (JP)

( * ) Notice: Subject to any disclaimer, the term of this patent is extended or adjusted under 35 U.S.C. 154(b) by 8 days.

(21) Appl. No.: 12/850,004

(22) Filed: Aug. 4, 2010

(65) Prior Publication Data

US 2011/0030133 A1 Feb. 10, 2011

(30) Foreign Application Priority Data

Aug. 6, 2009 (JP) ..... 2009-183612
May 17, 2010 (JP) ..... 2010-113087

(51) Int. Cl.
*A47K 3/022* (2006.01)

(52) U.S. Cl. ..... 4/443; 4/448

(58) Field of Classification Search ..... 4/443–448, 4/420–420.2, 420.4, 615
See application file for complete search history.

(56) References Cited

U.S. PATENT DOCUMENTS 1,935,201 A * 11/1933 Callejo ..... 4/448
2,872,687 A * 2/1959 Maurer ..... 4/420.2
2,875,450 A * 3/1959 Umann ..... 4/447
3,247,524 A * 4/1966 Umann ..... 4/420.2
3,577,567 A * 5/1971 Wintercorn ..... 4/445
3,662,407 A * 5/1972 Colucci ..... 4/420.2
3,810,260 A * 5/1974 Lodi ..... 4/420.4
3,995,326 A * 12/1976 Umann ..... 4/420.1
4,028,745 A * 6/1977 Caniglia ..... 4/420.2
4,123,807 A * 11/1978 Oguma et al. ..... 4/448
4,192,023 A * 3/1980 McComb ..... 4/448
4,237,560 A * 12/1980 Riegelman et al. ..... 4/447
4,304,016 A * 12/1981 Oguma et al. ..... 4/420.2
4,370,764 A * 2/1983 Ando et al. ..... 4/443
4,553,274 A * 11/1985 Yui ..... 4/420.4
4,980,931 A * 1/1991 Meisels ..... 4/233

(Continued)

FOREIGN PATENT DOCUMENTS

JP 6065954 * 3/1994

(Continued)

OTHER PUBLICATIONS

European Search Report for 10 17 1233 dated Nov. 8, 2010.

*Primary Examiner* — Lori Baker
(74) *Attorney, Agent, or Firm* — Pearne & Gordon LLP

(57) ABSTRACT

A sanitary washing device, includes: a nozzle including a water discharge port and configured to squirt water from the water discharge port to wash a human private part; a water conduit configured to guide water supplied from a water supply source to the nozzle; a sterilizing water supply part provided midway along the water conduit and capable of producing sterilizing water; a flow rate adjusting part configured to adjust flow rate of water flowing in the sterilizing water supply part; a flow state varying part configured to vary flow state of water flowing in the water conduit; and a controller configured to control the flow state varying part to vary the flow state of the water flowing in the water conduit when producing the sterilizing water by the sterilizing water supply part in a state in which the controller controls the flow rate adjusting part to make the flow rate of the water flowing in the sterilizing water supply part lower than maximum flow rate.

7 Claims, 7 Drawing Sheets

U.S. PATENT DOCUMENTS

| | | | | |
|---|---|---|---|---|
| 4,987,617 | A * | 1/1991 | Furukawa et al. | 4/448 |
| 5,138,726 | A * | 8/1992 | Campbell | 4/420.4 |
| 5,201,080 | A * | 4/1993 | Tanaka et al. | 4/443 |
| 5,566,402 | A * | 10/1996 | Agha el-Rifai et al. | 4/420.4 |
| 5,630,234 | A * | 5/1997 | Childs | 4/420.4 |
| 6,105,178 | A * | 8/2000 | Kurisaki et al. | 4/420.4 |
| 6,754,912 | B1 | 6/2004 | Hayashi et al. | |
| 7,284,285 | B2 * | 10/2007 | Scalzi | 4/420.1 |
| 7,316,038 | B2 * | 1/2008 | Egeresi | 4/420.4 |
| 2006/0096017 | A1 * | 5/2006 | Yamasaki et al. | 4/420 |

FOREIGN PATENT DOCUMENTS

| | | | |
|---|---|---|---|
| JP | 09-144103 | A | 6/1997 |
| JP | 3487447 | A | 10/2003 |
| WO | 95/32922 | A | 12/1995 |
| WO | 2006/135166 | A1 | 12/2006 |
| WO | 2007/004790 | A1 | 1/2007 |

* cited by examiner

SANITARY WASHING DEVICE

CROSS-REFERENCE TO RELATED APPLICATIONS

This application is based upon and claims the benefit of priorities from the prior Japanese Patent Application No. 2009-183612, filed on Aug. 6, 2009 and the prior Japanese Patent Application No. 2010-113087, filed on May 17, 2010; the entire contents of which are incorporated herein by reference.

BACKGROUND

1. Technical Field

Embodiments described herein relate generally to a sanitary washing device, and more particularly to a sanitary washing device for washing with water the "bottom" and other parts of a user seated on a sit-down toilet.

2. Background Art

When a washing nozzle for private parts washing squirts wash water at the private parts, at least part of the washing nozzle is exposed (advanced) outside from a casing installed with prescribed functional components including the washing nozzle and a hot water tank. Hence, dirt and dirty water may be attached to the washing nozzle. In this context, there is a sanitary washing device which cleans away dirt and dirty water attached to the washing nozzle before and/or after private parts washing. Thereby, the washing nozzle is kept clean.

However, in a humid environment such as a toilet room, even after dirt and dirty water attached to the washing nozzle are cleaned away, bacteria may grow on the washing nozzle over time. More specifically, bacteria such as methylobacteria, called pink slime, and black mold grow on the bowl surface of the toilet stool. Such bacteria may be attached to the washing nozzle, and multiply thereon. Multiplication of bacteria results in an aggregation of bacteria and their secretion (slime, black stain), called biofilm. The biofilm is difficult to remove by the normal nozzle cleaning as mentioned above.

In this context, Japanese Patent No. 3487447 proposes a sanitary washing device. In this sanitary washing device, an electrolytic cell is connected to a flow channel for supplying wash water. The electrolytic cell produces water containing hypochlorous acid. This water is regularly supplied to sterilize the washing nozzle so as to avoid biofilm formation. Here, hypochlorous acid is produced by electrolysis of chlorine ions in tap water. However, the concentration of chlorine ions in tap water varies with geographical area. Hence, there is demand for ensuring the concentration of hypochlorous acid required to sterilize the washing nozzle even for a lower concentration of chlorine ions in tap water.

In this context, International Publication Pamphlet WO 95/32922 proposes an electrolyzing device and electrolyzing method for producing water containing hypochlorous acid. This document describes the relationship between current density and chlorine generation efficiency. According to this document, higher current density results in higher chlorine generation efficiency, and the chlorine generation efficiency is maximized at current densities within a certain range. However, if the current is increased to increase the chlorine generation efficiency to ensure the concentration of hypochlorous acid, the load on the electrodes of the electrolytic cell increases. In this respect, there is room for improvement. Furthermore, in view of the electrode lifetime, increased load on the electrodes is not very desirable for a sanitary washing device having electrodes with a relatively small area.

On the other hand, JP-A 9-144103 (Kokai) discloses a toilet unit with a sterilizing water supply function. In this toilet stool, sterilizing water is produced by a continuous electrolytic cell. At appropriate timing, a sterilizing water control circuit supplies the sterilizing water to a toilet bowl through a sterilizing water piping to sterilize bacteria in the toilet bowl. According to this document, the free chlorine concentration in the sterilizing water can be controlled by adjusting the flow rate of water flowing in the interelectrode path of the continuous electrolytic cell. Thus, for example, even for a lower concentration of chlorine ions in tap water, the concentration of hypochlorous acid required to sterilize the washing nozzle can be ensured by reducing the flow rate of supplied water. On the other hand, even for a higher concentration of chlorine ions in tap water, demand for sterilizing water with higher concentration is met by reducing the flow rate of supplied water.

However, if the flow rate of supplied water is reduced, the flow rate of water for cleaning the washing nozzle is also reduced. The washing nozzle is typically provided with a plurality of water discharge ports, and flow channels respectively corresponding to the plurality of water discharge ports. If the sterilizing water is produced with lower flow rate of supplied water and passed through all the flow channels, then the concentration of sterilizing water can indeed be increased. However, the force of cleaning away dirt and dirty water attached to the washing nozzle, i.e., the force of removing dirt and dirty water from the washing nozzle, may be insufficient.

SUMMARY

According to an aspect of the invention, there is provided a sanitary washing device, including: a nozzle including a water discharge port and configured to squirt water from the water discharge port to wash a human private part; a water conduit configured to guide water supplied from a water supply source to the nozzle; a sterilizing water supply part provided midway along the water conduit and capable of producing sterilizing water; a flow rate adjusting part configured to adjust flow rate of water flowing in the sterilizing water supply part; a flow state varying part configured to vary flow state of water flowing in the water conduit; and a controller configured to control the flow state varying part to vary the flow state of the water flowing in the water conduit when producing the sterilizing water by the sterilizing water supply part in a state in which the controller controls the flow rate adjusting part to make the flow rate of the water flowing in the sterilizing water supply part lower than maximum flow rate.

DETAILED DESCRIPTION

Figure 1:
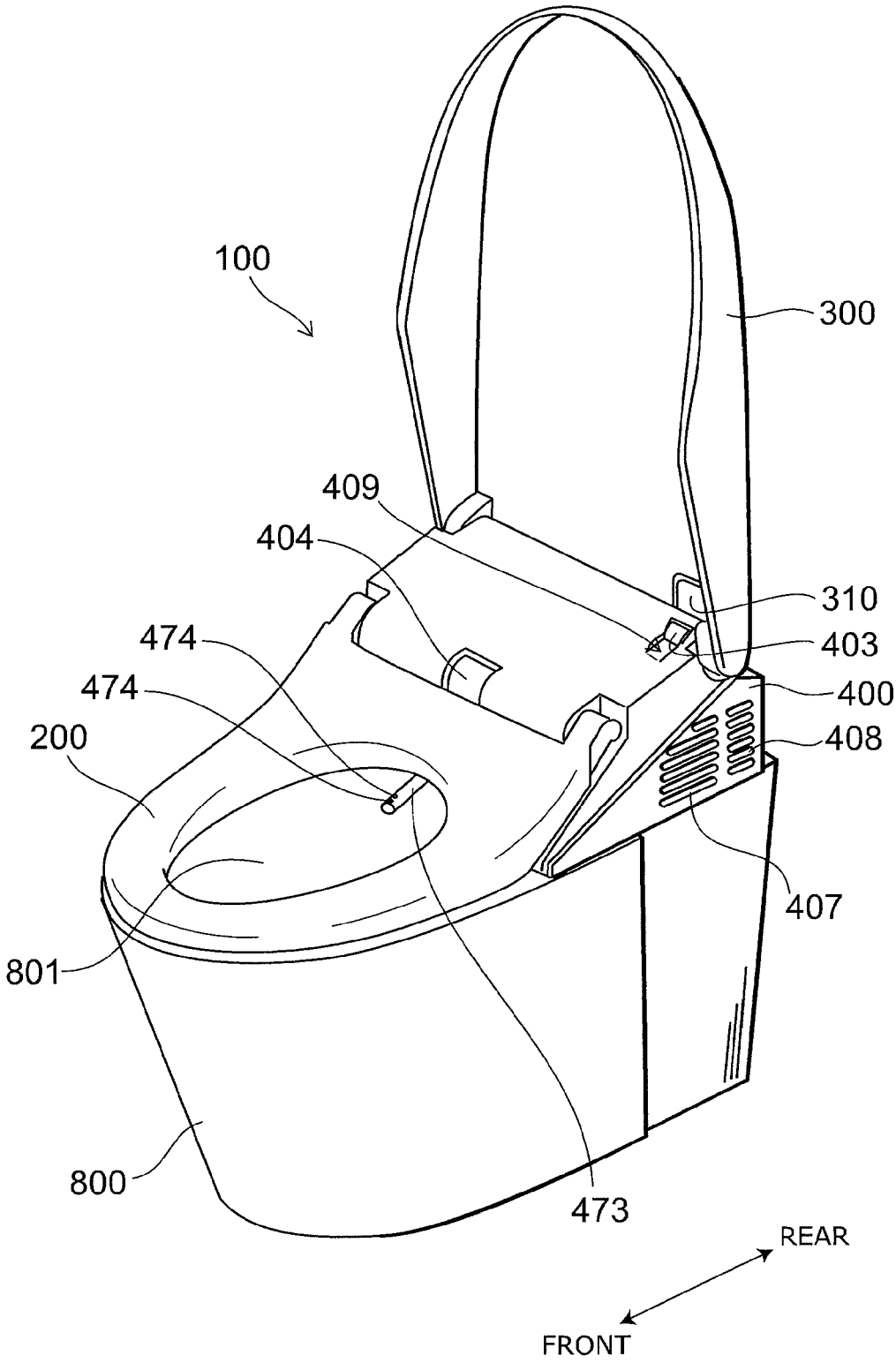
FIG. 1 is a perspective schematic view showing a toilet device provided with a sanitary washing device according to an embodiment of the invention.

According to a first aspect of the invention, a sanitary washing device includes a nozzle including a water discharge port and configured to squirt water from the water discharge port to wash a human private part; a water conduit configured to guide water supplied from a water supply source to the nozzle; a sterilizing water supply part provided midway along the water conduit and capable of producing sterilizing water; a flow rate adjusting part configured to adjust flow rate of water flowing in the sterilizing water supply part; a flow state varying part configured to vary flow state of water flowing in the water conduit; and a controller configured to control the flow state varying part to vary the flow state of the water flowing in the water conduit when producing the sterilizing water by the sterilizing water supply part in a state in which the controller controls the flow rate adjusting part to make the flow rate of the water flowing in the sterilizing water supply part lower than maximum flow rate.

In this sanitary washing device, in the case where the controller controls the flow rate adjusting part to make the flow rate of water supplied to the electrolytic cell lower than the maximum flow rate when producing sterilizing water, the controller controls the flow state varying part to vary the flow state of water flowing in the water conduit. According to this, an unsteady flow occurs on the surface of the nozzle and inside the water conduit. Thus, the force of removing dirt and bacteria present on the surface of the nozzle and the inner wall of the water conduit is made higher than in the case of no variation in the flow state of water. Thereby, the flow velocity and flow rate of water required to remove dirt and dirty water from the nozzle can be ensured while ensuring the concentration of sterilizing water. In other words, the nozzle can be sterilized more efficiently.

According to a second aspect of the invention, the sanitary washing device of the first aspect further includes: a first flow channel configured to guide the water supplied from the water supply source to the water discharge port of the nozzle; a second flow channel configured to guide the water supplied from the water supply source to a surface of the nozzle; and a flow channel switching part capable of switching between a state in which the water supplied from the water supply source is passed through the first flow channel and a state in which the water supplied from the water supply source is passed through the second flow channel. The controller controls the flow channel switching part to pass the sterilizing water through only one of the first flow channel and the second flow channel.

In this sanitary washing device, in the case where the controller controls the flow rate adjusting part to make the flow rate of water supplied to the sterilizing water supply part is lower than the maximum flow rate when producing sterilizing water, the controller can control the flow channel switching part to pass the sterilizing water through only one of the first flow channel and the second flow channel. According to this, the controller can ensure the force (water force) of removing dirt and dirty water from the nozzle while ensuring the concentration of sterilizing water by decreasing the flow rate of water supplied to the sterilizing water supply part. Thus, the nozzle can be sterilized more efficiently. Furthermore, the cleanliness of the nozzle as viewed from the user can be improved.

According to a third aspect of the invention, in the sanitary washing device of the first aspect, the flow state varying part is a pressure modulator provided downstream of the sterilizing water supply part and configured to provide pulsation or acceleration to the flow of the water.

In this sanitary washing device, the pressure modulator can provide pulsation or acceleration to the flow of water in the water conduit. Thereby, the pressure modulator can impart wavelike flow state to the flow of water in the water conduit. Thus, the force of removing dirt and dirty water from the nozzle can be ensured while ensuring the concentration of sterilizing water.

According to a fourth aspect of the invention, in the sanitary washing device of the first aspect, the sterilizing water supply part is an electrolytic cell.

In this sanitary washing device, the sterilizing water supply part is an electrolytic cell. Hence, the concentration of sterilizing water produced in the electrolytic cell can be increased more efficiently by decreasing the flow rate of water supplied to the electrolytic cell.

According to a fifth aspect of the invention, the sanitary washing device of the fourth aspect further includes: an ion concentration detecting part capable of detecting concentration of chlorine ions in the water flowing into the electrolytic cell. In the case where the concentration of the chlorine ions detected by the ion concentration detecting part is equal to or lower than a prescribed concentration, the sterilizing water is produced in the electrolytic cell in a state in which the controller controls the flow rate adjusting part to make the flow rate of the water flowing in the electrolytic cell lower than maximum flow rate.

For example, when hypochlorous acid is produced in the electrolytic cell, the concentration of chlorine ions in tap water used as a raw material is one of the important factors. Hence, in this sanitary washing device, the controller can increase the concentration of hypochlorous acid more efficiently by determining the timing of increasing the concentration of hypochlorous acid based on the concentration of chlorine ions in the water flowing into the electrolytic cell.

According to a sixth aspect of the invention, the sanitary washing device of the first aspect further includes: a heating part provided upstream of the sterilizing water supply part and capable of heating the water supplied from the water supply source. The controller controls the heating part to heat the water when producing the sterilizing water by the sterilizing water supply part.

In this sanitary washing device, the controller controls the heating part to heat the water when producing the sterilizing water by the sterilizing water supply part. According to this, the cleaning power of the sterilizing water can be further improved. Furthermore, in the case where the sterilizing water supply part is an electrolytic cell, the electrolysis efficiency in the electrolytic cell increases. Hence, the electrolytic cell can further increase the concentration of hypochlorous acid.

According to a seventh aspect of the invention, the sanitary washing device of the first aspect further includes: an air bubble injecting part provided downstream of the sterilizing water supply part and capable of injecting air into the sterilizing water to produce air bubbles.

In this sanitary washing device, the air bubble injecting part can inject air into the sterilizing water to produce air bubbles in the sterilizing water. This increases the apparent flow rate of the sterilizing water mixed with air. Hence, the flow velocity and flow rate of water required to remove dirt and dirty water from the nozzle can be ensured. Thereby, the force of removing dirt and bacteria present on the surface of the nozzle and the inner wall of the water conduit can be ensured.

Embodiments of the invention will now be described with reference to the drawings. In the drawings, similar components are labeled with like reference numerals, and the detailed description thereof is omitted as appropriate.

FIG. 1 is a perspective schematic view showing a toilet device provided with a sanitary washing device according to an embodiment of the invention.

Figure 2:
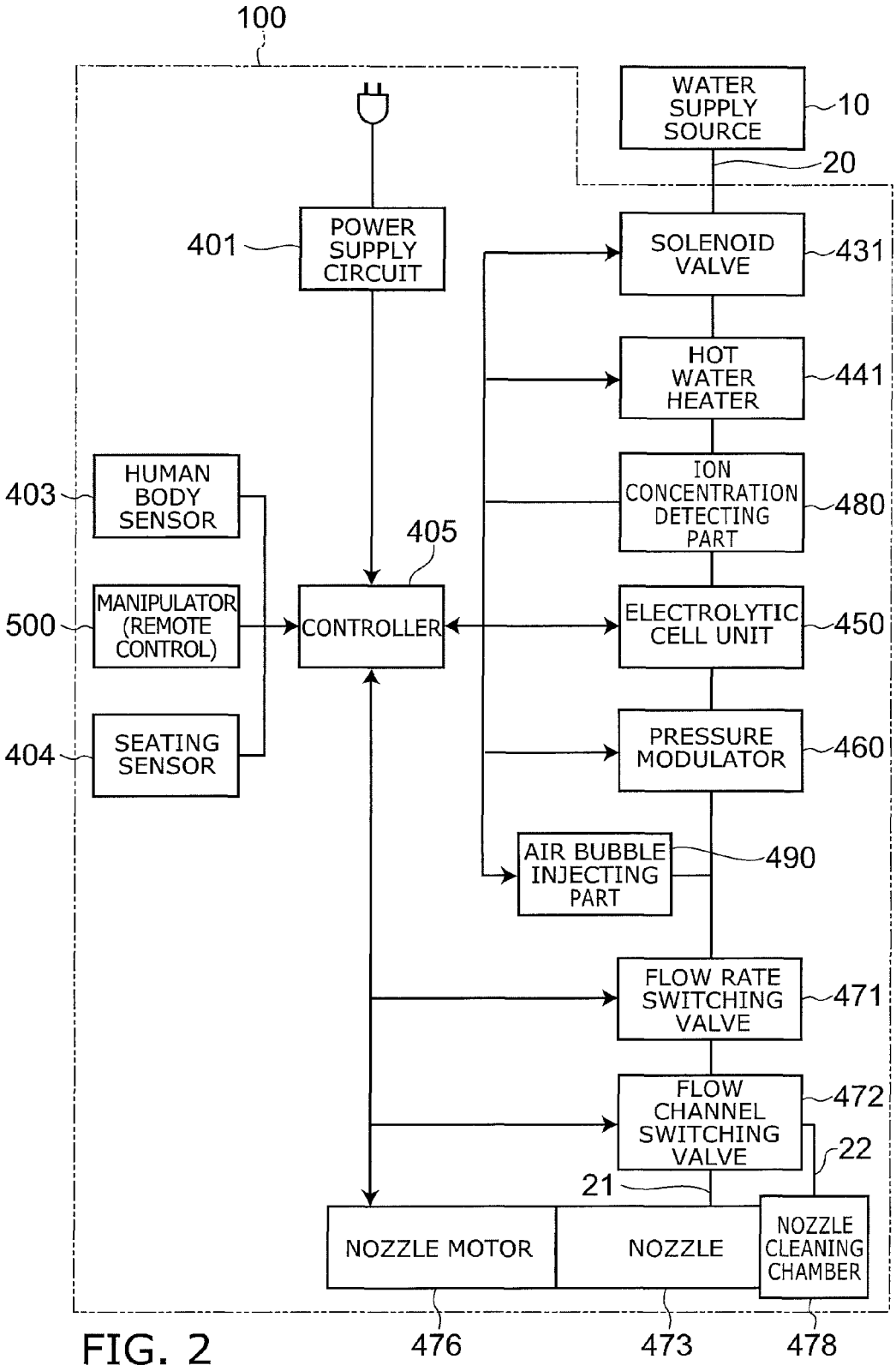
FIG. 2 is a block diagram showing the relevant configuration of the sanitary washing device according to the embodiment.

FIG. 2 is a block diagram showing the relevant configuration of the sanitary washing device according to this embodiment.

Figure 3:
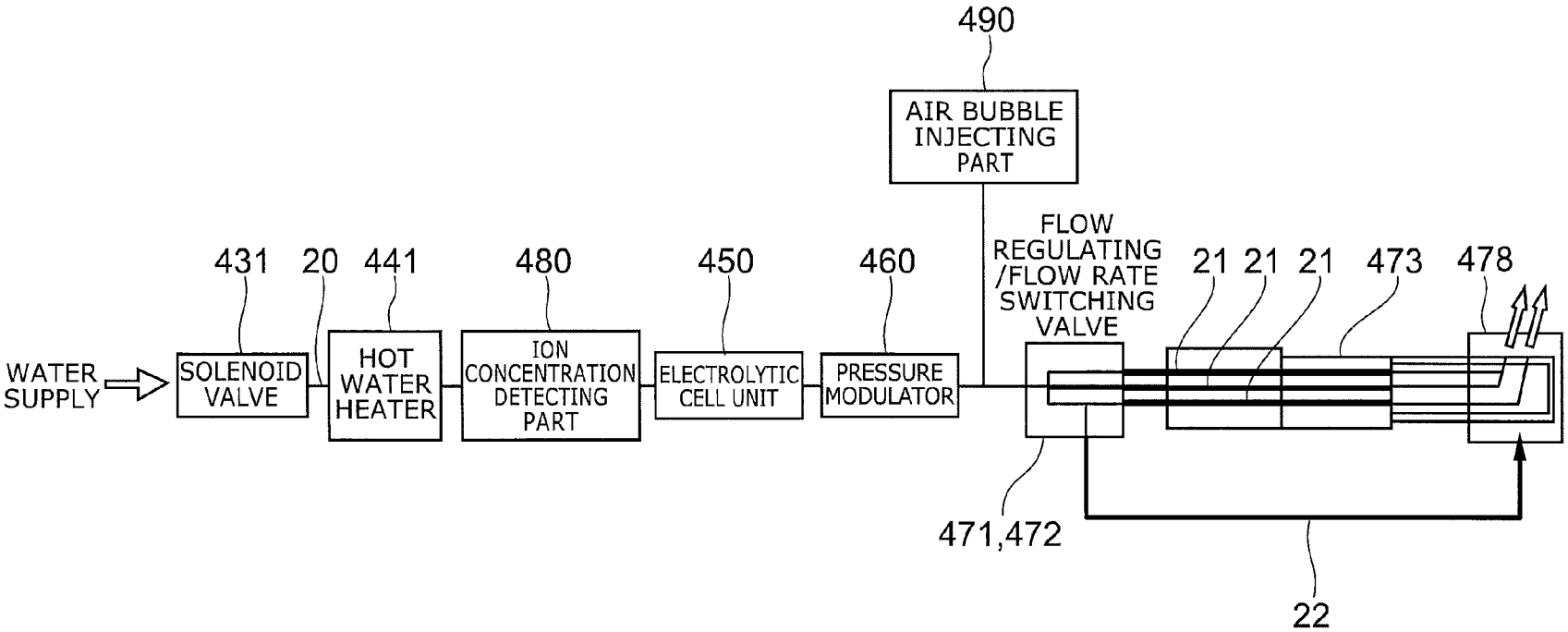
FIG. 3 is a block diagram showing the relevant configuration of a water channel system of a sanitary washing device according to a variation of the embodiment.

FIG. 3 is a block diagram showing the relevant configuration of the water channel system of the sanitary washing device according to a variation of this embodiment.

In FIG. 2, the relevant configuration of the water channel system and the electrical system is shown together.

The toilet device shown in FIG. 1 includes a sit-down toilet stool (hereinafter simply referred to as "toilet stool" for convenience of description) 800 and a sanitary washing device 100 provided thereon. The sanitary washing device 100 includes a casing 400, a toilet seat 200, and a toilet lid 300. The toilet seat 200 and the toilet lid 300 are each pivotally supported on the casing 400 in an openable/closable manner.

In the casing 400, a private parts washing functional part and the like for washing the "bottom" and other parts of a user seated on the toilet seat 200 are installed. Furthermore, for example, the casing 400 includes a seating sensor 404 for sensing a user seated on the toilet seat 200. When the seating sensor 404 is sensing a user seated on the toilet seat 200, the user can manipulate a manipulator 500 such as a remote control to advance a washing nozzle (hereinafter simply referred to as "nozzle" for convenience of description) 473 into a bowl 801 of the toilet stool 800. In the sanitary washing device 100 shown in FIG. 1, the nozzle 473 is advanced into the bowl 801.

One or more water discharge ports 474 are provided at the tip of the nozzle 473. The nozzle 473 can squirt water from the discharge port 474 provided at its tip to wash the "bottom" and other parts of the user seated on the toilet seat 200. Here, the term "water" used herein refers not only to cold water, but also to heated hot water.

More specifically, as shown in FIG. 2, the sanitary washing device 100 according to this embodiment includes a water conduit 20 for guiding water supplied from a water supply source 10 such as waterworks and flush tank. A solenoid valve 431 is provided on the upstream side of the water conduit 20. The solenoid valve 431 is an openable/closable solenoid valve, and regulates water supply based on commands from a controller 405 provided inside the casing 400.

A hot water heater 441 is provided downstream of the solenoid valve 431. The hot water heater 441 heats supplied water to hot water with a prescribed temperature. The temperature of the hot water can be configured by, for example, the user manipulating the manipulator 500.

An ion concentration detecting part 480 is provided downstream of the hot water heater 441. The ion concentration detecting part 480 can detect the concentration of chlorine ions in the water flowing into an electrolytic cell unit (sterilizing water supply part) 450. The ion concentration detecting part 480 can sense the water quality of tap water (e.g., the electrical conductivity of water flowing into the electrolytic cell unit 450) by voltage applied to the electrolytic cell unit 450 to detect the concentration of chlorine ions in the tap water. The ion concentration detecting part 480 can produce a detection signal from the detected concentration of chlorine ions and transmit the detection signal to the controller 405.

The electrolytic cell unit 450 that is capable of producing sterilizing water is provided downstream of the ion concentration detecting part 480. This electrolytic cell unit 450 is described later in detail.

A pressure modulator (flow state varying part) 460 is provided downstream of the electrolytic cell unit 450. This pressure modulator 460 provides pulsation or acceleration to the flow of water in the water conduit 20. Thus, the pressure modulator 460 can provide pulsation to the water discharged from the water discharge port 474 of the nozzle 473 and the water discharge portion 479 of the nozzle cleaning chamber 478 (see FIG. 7). In other words, the pressure modulator 460 can vary the flow state of water flowing in the water conduit 20.

A flow rate switching valve (flow rate adjusting part) 471 for adjusting the water force (flow rate), and a flow channel switching valve (flow channel switching part) 472 for opening/closing and switching water supply to the nozzle 473 and the nozzle cleaning chamber 478 are provided downstream of the pressure modulator 460. Here, as in the variation shown in FIG. 3, the flow rate switching valve 471 and the flow channel switching valve 472 may be provided as a single unit.

Furthermore, an air bubble injecting part 490 is connected to the water conduit 20 on the downstream side of the pressure modulator 460. By the ejector effect of the flow of water or sterilizing water flowing inside the water conduit 20, the air bubble injecting part 490 can inject air into the water or sterilizing water to produce air bubbles. The amount of injected air can be adjusted by, for example, the controller 405 controlling the operation of the air bubble injecting part 490. Here, the method for injecting air into water or sterilizing water is not limited to the method of using the ejector effect of water flow. As an alternative method, a pump may be used to introduce air into the water conduit 20.

Furthermore, a nozzle 473 and a nozzle cleaning chamber 478 are provided downstream of the flow rate switching valve 471 and the flow channel switching valve 472. The nozzle 473 can be advanced into or retracted from the bowl 801 of the toilet stool 800 under a driving force from a nozzle motor 476. In other words, the nozzle motor 476 can advance/retract the nozzle 473 based on commands from the controller 405. On the other hand, in the nozzle cleaning chamber 478, by squirting sterilizing water or water from the water discharge portion 479 (see FIG. 7) provided therein, the outer peripheral surface (body) of the nozzle 473 can be sterilized or cleaned.

Here, a first flow channel 21 for connecting the flow channel switching valve 472 to the nozzle 473 is provided downstream of the flow channel switching valve 472. The first flow channel 21 can guide water supplied from the water supply source 10 and sterilizing water produced in the electrolytic cell unit 450 to the nozzle 473. Furthermore, a second flow channel 22 for connecting the flow channel switching valve 472 to the nozzle cleaning chamber 478 is provided downstream of the flow channel switching valve 472. The second flow channel 22 can guide water supplied from the water supply source 10 and sterilizing water produced in the electrolytic cell unit 450 to the nozzle cleaning chamber 478. In other words, the controller 405 can control the flow channel switching valve 472 to guide water or sterilizing water to the water discharge port 474 of the nozzle 473 through the first flow channel 21 and to guide water or sterilizing water to the water discharge portion 479 of the nozzle cleaning chamber 478 through the second flow channel 22. In the block diagram shown in FIG. 3, the first flow channel includes multiple flow channels so that water can be passed to water discharge ports for "bidet wash" and "bottom wash".

Furthermore, the controller 405 is supplied with electrical power from a power supply circuit 401. Based on signals from a human body sensor 403, seating sensor 404, and manipulator 500, and etc., the controller 405 can control the operation of the solenoid valve 431, hot water heater 441, electrolytic cell unit 450, pressure modulator 460, flow rate switching valve 471 and flow channel switching valve 472, nozzle motor 476, and air bubble injecting part 490.

As shown in FIG. 1, the human body sensor 403 is embedded in a recess 409 formed in the upper surface of the casing 400. The human body sensor 403 can sense a user (human body) approaching the toilet seat 200. Furthermore, a transparent window 310 is provided at the rear of the toilet lid 300. Hence, in the closed state of the toilet lid 300, the human body sensor 403 can sense the presence of a user through the transparent window 310. For example, when the human body sensor 403 senses a user, the controller 405 can automatically open the toilet lid 300 based on the sensing result of the human body sensor 403.

The casing 400 may further include various mechanisms as needed, such as a "warm air drying function" for blowing warm air toward the "bottom" and other parts of the user seated on the toilet seat 200, a "deodorizing unit", and a "room heating unit". In this case, an exhaust port 407 for the deodorizing unit and a vent 408 for the room heating unit are provided as needed on the side surface of the casing 400. However, in this invention, the sanitary washing functional part and other added functional parts are not necessarily provided.

Figure 4:
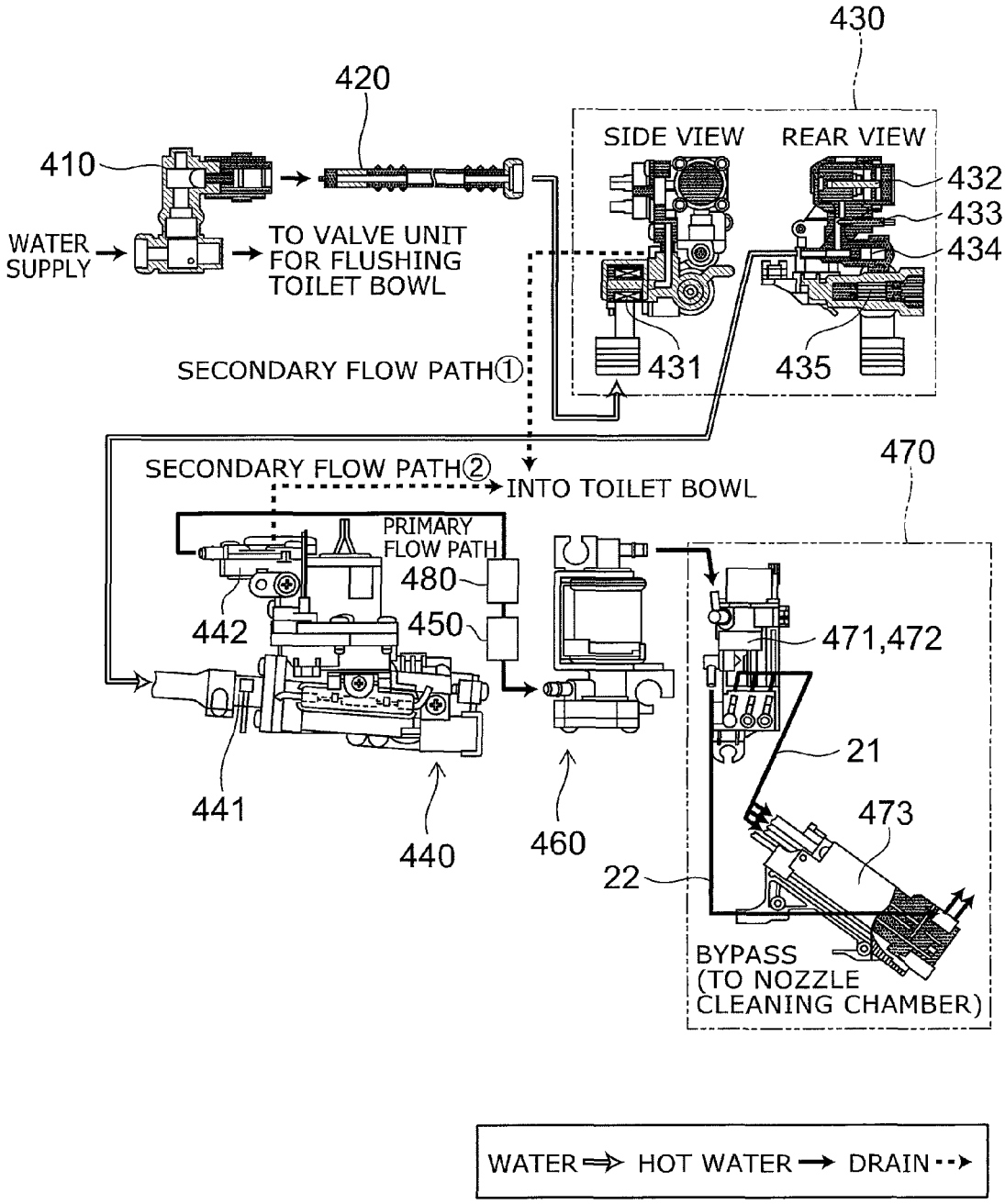
FIG. 4 is a block diagram illustrating an example of the relevant configuration of a water channel system of the sanitary washing device according to the embodiment.

FIG. 4 is a block diagram illustrating an example of the relevant configuration of the water channel system of the sanitary washing device according to this embodiment.

Figure 5:
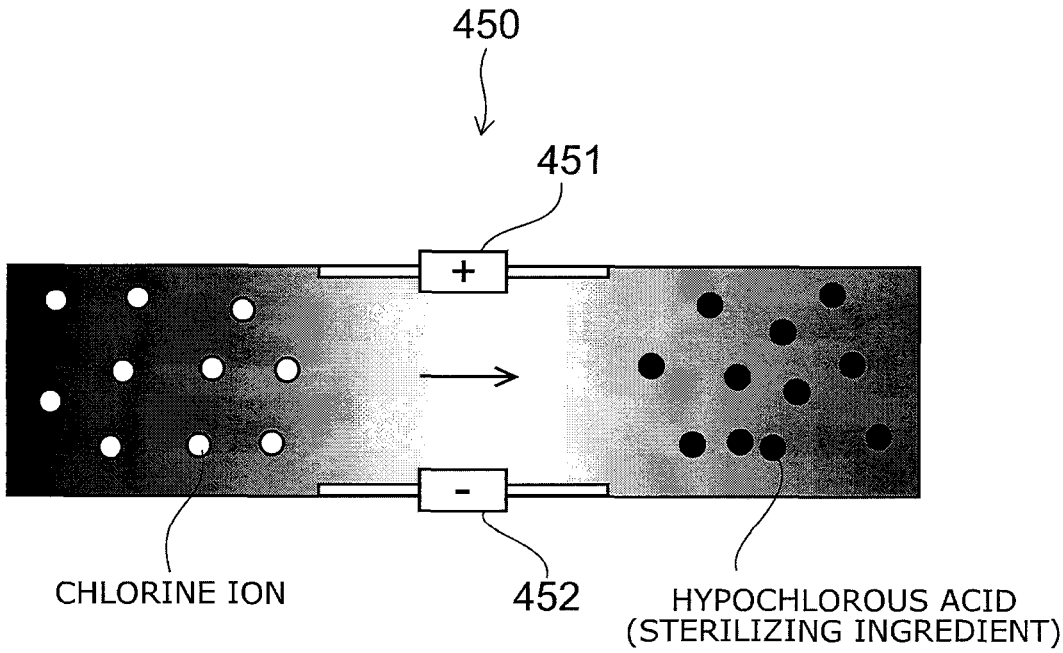
FIG. 5 is a sectional schematic view illustrating an example of an electrolytic cell unit of the embodiment.

FIG. 5 is a sectional schematic view illustrating an example of the electrolytic cell unit of this embodiment.

Figure 6:
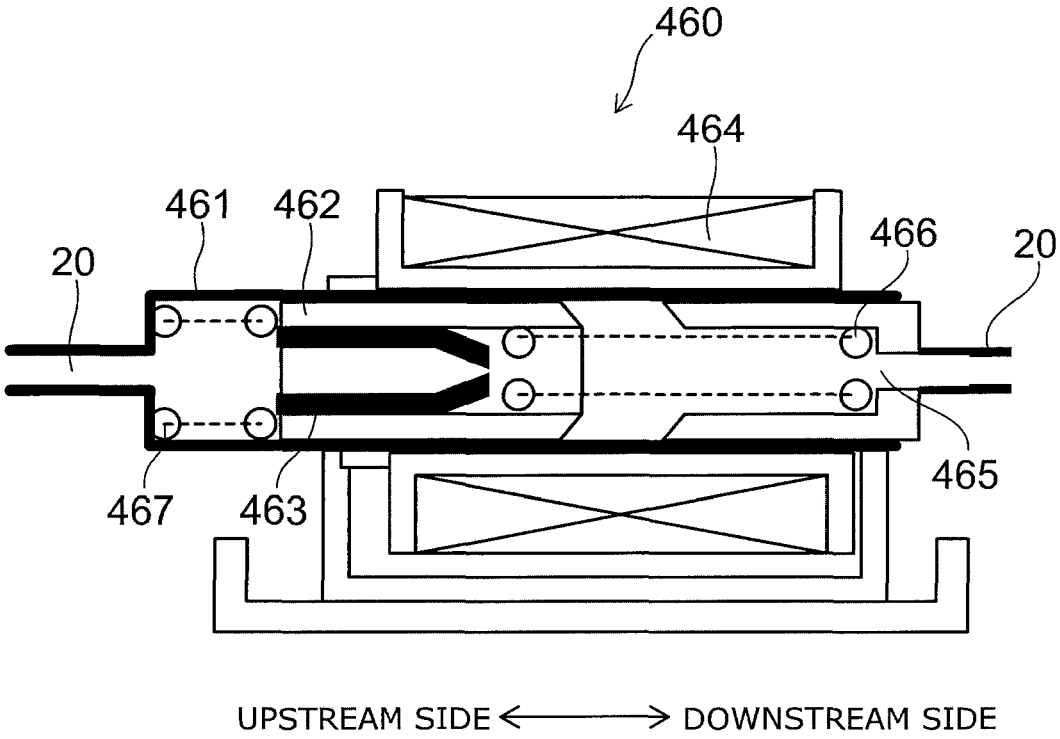
FIG. 6 is a sectional schematic view schematically showing the internal structure of a pressure modulator of the embodiment.

FIG. 6 is a sectional schematic view schematically showing the internal structure of the pressure modulator of this embodiment.

Figure 7:
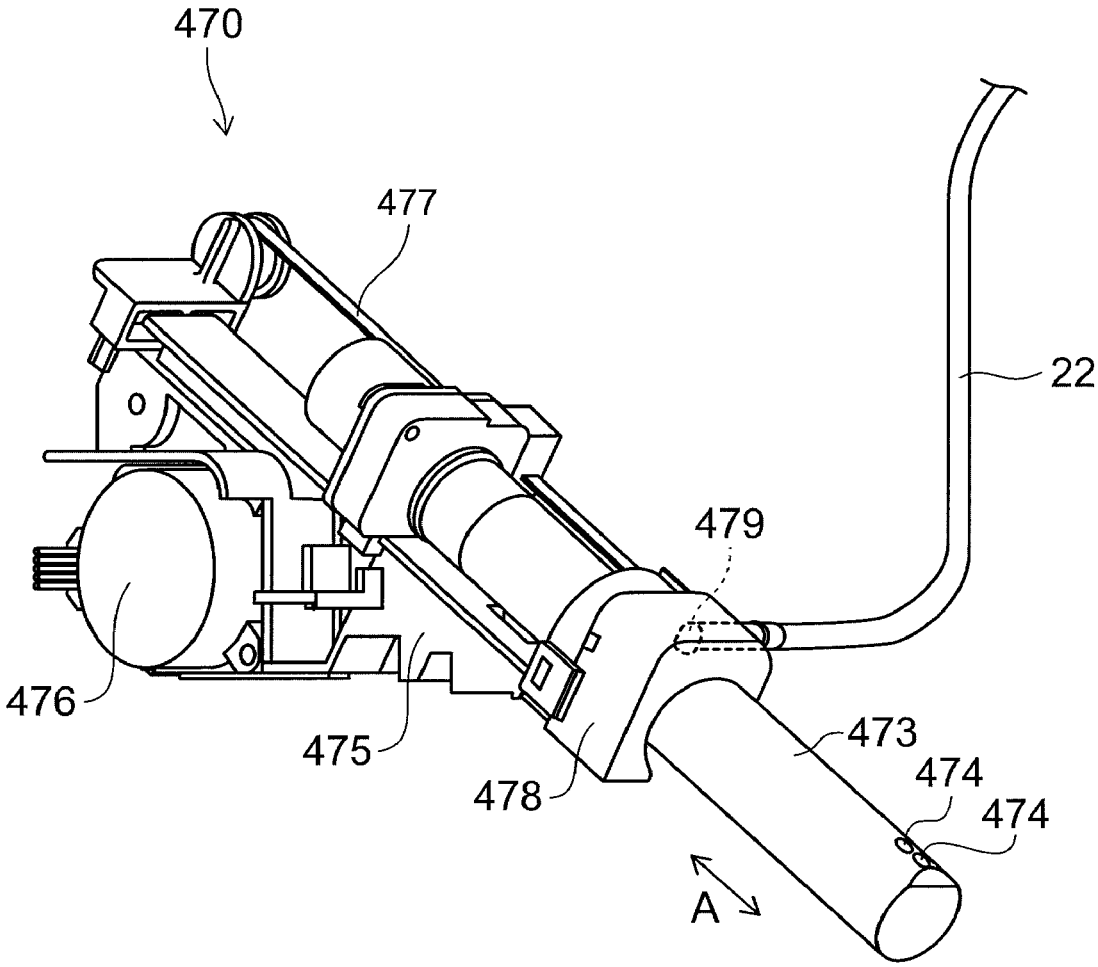
FIG. 7 is a perspective schematic view illustrating an example of a nozzle unit of the embodiment.

FIG. 7 is a perspective schematic view illustrating an example of the nozzle unit of this embodiment.

As shown in FIG. 4, water supplied from the water supply source 10 is first guided to a metal branch 410. The water guided to the metal branch 410 is distributed to a coupling hose 420 and to a not-illustrated valve unit for flushing the toilet bowl. However, the toilet device provided with the sanitary washing device 100 according to this embodiment is not limited to the so-called "direct-pressure type." The toilet device may be of the so-called "low-tank type". Hence, in the case where the toilet device is of the "low-tank type", the water guided to the metal branch 410 is guided to a not-illustrated low tank instead of the valve unit for flushing the toilet bowl.

Next, the water supplied to the coupling hose 420 is guided to a valve unit 430. The valve unit 430 includes a solenoid valve 431, a pressure regulator valve 432, an incoming water thermistor 433, a safety valve 434, and a drain plug 435. The pressure regulator valve 432 serves to regulate the water supply pressure to within a prescribed pressure range when the water supply pressure is high. The incoming water thermistor 433 senses the temperature of water guided to a heat exchanger unit 440. The safety valve 434 is opened to drain water to the bowl 801 of the toilet stool 800 when the pressure of the water conduit 20 is increased. By providing the safety valve 434, water leakage inside the sanitary washing device 100 can be prevented even in the case where, for example, failure in the pressure regulator valve 432 results in increasing the pressure of the water conduit 20 on the secondary (downstream) side thereof. The drain plug 435 is used when, for example, the water in the water conduit 20 may be frozen. The drain plug 435 can drain the water in the water conduit 20. The solenoid valve 431 is as described above.

Next, the water supplied to the valve unit 430 is guided to a heat exchanger unit 440. The heat exchanger unit (heating part) 440 includes a hot water heater 441 and a vacuum breaker 442. The vacuum breaker 442 prevents backflow of dirty water from the nozzle 473 when, for example, negative pressure occurs in the valve unit 430. Or, the vacuum breaker 442 promotes drainage of the water conduit 20 between the heat exchanger unit 440 and the nozzle unit 470 by taking in air from outside when the water conduit 20 is drained. The water from the vacuum breaker 442 is ejected to the bowl 801 of the toilet stool 800.

Next, the water supplied to the heat exchanger unit 440 and heated to a prescribed temperature is guided to the electrolytic cell unit 450 through the ion concentration detecting part 480. As described above with reference to FIG. 1 and FIG. 2, the electrolytic cell unit 450 can produce sterilizing water. Here, the electrolytic cell unit 450 of this embodiment is described with reference to the drawings.

As shown in FIG. 5, the electrolytic cell unit 450 includes therein an anode plate 451 and a cathode plate 452. Under energization controlled by the controller 405, the electrolytic cell unit 450 can electrolyze tap water flowing therein. Here, the tap water contains chlorine ions. Such chlorine ions are contained as salt (NaCl) and calcium chloride ($CaCl_2$) in water sources (e.g., groundwater and water in dams and rivers). Thus, hypochlorous acid is produced by electrolysis of the chlorine ions. As a result, the water electrolyzed in the electrolytic cell unit 450 turns into a liquid containing hypochlorous acid.

Hypochlorous acid functions as a sterilizing ingredient. A solution containing hypochlorous acid, i.e., sterilizing water, can efficiently remove or decompose, and sterilize, dirt such as resulting from ammonia, or the like. Here, the term "sterilizing water" used herein refers to a solution containing a sterilizing ingredient such as hypochlorous acid more than tap water (also simply referred to as "water").

Thus, the tap water supplied from the heat exchanger unit 440 is electrolyzed in the electrolytic cell unit 450 and turns into a solution containing hypochlorous acid. The solution is guided to the nozzle unit 470 through the pressure modulator 460.

Here, the pressure modulator 460 is described with reference to the drawings.

As described above with reference to FIG. 2, the pressure modulator 460 can provide pulsation or acceleration to the flow of water in the water conduit 20. Here, the term "pulsation" used herein refers to pressure variation caused by the pressure modulator 460. Thus, the pressure modulator 460 is a device for varying the pressure of water in the water conduit 20.

As shown in FIG. 6, the pressure modulator 460 includes a cylinder 461 connected to the water conduit 20, a plunger 462 reciprocably provided inside the cylinder 461, a check valve 463 provided inside the plunger 462, and a pulsation generating coil 464 for reciprocating the plunger 462 under a controlled excitation voltage.

The check valve is disposed so that the pressure of water on the downstream side of the pressure modulator 460 increases when the position of the plunger 462 is changed to the nozzle 473 side (downstream side) and that the pressure of water on the downstream side of the pressure modulator 460 decreases when the position of the plunger 462 is changed to the side opposite to the nozzle (upstream side). In other words, the pressure of water on the upstream side of the pressure modulator 460 decreases when the position of the plunger 462 is changed to the nozzle 473 side (downstream side). The pressure of water on the upstream side of the pressure modulator 460 increases when the position of the plunger 462 is changed to the side opposite to the nozzle (upstream side).

The plunger 462 is moved to the upstream side or to the downstream side by controlling the excitation of the pulsation generating coil 464. In other words, in the case of adding pulsation to the water in the water conduit 20 (in the case of varying the pressure of the water in the water conduit 20), the plunger 462 is reciprocated in the axial direction (upstream direction/downstream direction) of the cylinder 461 by controlling the excitation voltage applied to the pulsation generating coil 464.

In such a case, by excitation of the pulsation generating coil 464, the plunger 462 moves from the original position (plunger original position) as shown to the downstream side 465. Then, when the excitation of the coil is extinguished, the plunger 462 returns to the original position by the biasing force of a return spring 466. At this time, a buffer spring 467 buffers the return motion of the plunger 462. The plunger 462 includes therein a duckbill check valve 463 to prevent backflow to the upstream side.

Accordingly, when moving from the plunger original position to the downstream side, the plunger 462 can pressurize water in the cylinder 461 to drive the water to the water conduit 20 on the downstream side. In other words, when moving from the plunger original position to the downstream side, the plunger 462 can decompress water in the water conduit 20 on the upstream side to suck the water into the cylinder 461. At this time, because the plunger original position and the position after the motion to the downstream side are always the same, the amount of wash water fed to the water conduit 20 on the downstream side in response to the motion of the plunger 462 is constant.

Subsequently, at the time of return to the original position, wash water flows into the cylinder 461 through the check valve 463. Thus, at the next time when the plunger 462 moves to the downstream side, a constant amount of wash water is newly fed to the water conduit 20 on the downstream side.

As shown in FIG. 4, the nozzle unit 470 includes a flow rate switching valve 471, a flow channel switching valve 472, and a nozzle 473. In this example, the flow rate switching valve 471 and the flow channel switching valve 472 are provided as a single unit. The flow channel switching valve 472 can guide sterilizing water or water, which is supplied from the electrolytic cell unit 450 through the pressure modulator 460, to the water discharge port 474 of the nozzle 473 through the first flow channel 21. Or, the flow channel switching valve 472 can guide sterilizing water or water, which is supplied from the electrolytic cell unit 450 through the pressure modulator 460, to the water discharge portion 479 of the nozzle cleaning chamber 478 through the second flow channel 22 (see FIG. 7). Here, the nozzle unit 470 is described with reference to the drawings.

As shown in FIG. 7, the nozzle unit 470 of this embodiment includes a mounting stage 475 as a base stage, a nozzle 473 supported on the mounting stage 475, and a nozzle motor 476 for moving the nozzle 473. The nozzle 473 is provided so as to be slidable with respect to the mounting stage 475, as indicated by arrow A shown in FIG. 7, by the driving force transmitted from the nozzle motor 476 through a transmission member 477 such as a belt. That is, the nozzle 473 can linearly move in its own axial direction (advancing/retracting direction). The nozzle 473 can reciprocally move from the casing 400 and the mounting stage 475.

Furthermore, the nozzle unit 470 of this embodiment includes a nozzle cleaning chamber 478. The nozzle cleaning chamber 478 is fixed to the mounting stage 475. The nozzle cleaning chamber 478 includes therein a water discharge portion 479 connected to the second flow channel 22. Thus, the nozzle cleaning chamber 478 can sterilize or clean the outer peripheral surface (body) of the nozzle 473 by squirting sterilizing water or water from the water discharge portion 479. Specifically, in the case where the controller 405 energizes the anode plate 451 and the cathode plate 452 of the electrolytic cell unit 450 to produce sterilizing water, the body of the nozzle 473 is sterilized with the sterilizing water squirted from the water discharge portion 479. On the other hand, in the case where the controller 405 does not energize the anode plate 451 and the cathode plate 452 of the electrolytic cell unit 450, the body of the nozzle 473 is physically cleaned with water squirted from the water discharge portion 479.

More specifically, in a state in which the nozzle 473 is housed in the casing 400, a portion of the water discharge port 474 of the nozzle 473 is substantially housed in the nozzle cleaning chamber 478. Hence, the nozzle cleaning chamber 478 can sterilize or clean the portion of the water discharge port 474 of the nozzle 473 in the housed state by squirting sterilizing water or water from the water discharge portion 479 provided inside the nozzle cleaning chamber 478. Furthermore, the nozzle cleaning chamber 478 can sterilize or clean not only the portion of the water discharge port 474 but also the outer peripheral surface of the other portions by squirting water or sterilizing water from the water discharge portion 479 when the nozzle 473 is advanced or retracted.

Furthermore, in a state in which the nozzle 473 is housed in the casing 400, the nozzle 473 of this embodiment can sterilize or clean the portion of the water discharge port 474 by squirting sterilizing water or water from the water discharge port 474 of the nozzle 473 itself. Furthermore, in a state in which the nozzle 473 is housed in the casing 400, the portion of the water discharge port 474 of the nozzle 473 is substantially housed in the nozzle cleaning chamber 478. Hence, the sterilizing water or water discharged from the water discharge port 474 of the nozzle 473 is reflected by the inner wall of the nozzle cleaning chamber 478 and splashed on the portion of the water discharge port 474. Thus, the portion of the water discharge port 474 of the nozzle 473 is sterilized or cleaned also with the sterilizing water or water reflected by the inner wall of the nozzle cleaning chamber 478.

Here, in view of efficiently sterilizing the nozzle 473, it is more preferable that the concentration of hypochlorous acid produced in the electrolytic cell unit 450 is higher. Furthermore, by increasing the concentration of hypochlorous acid produced in the electrolytic cell unit 450, the cleanliness of the nozzle 473 as viewed from the user can be improved. At this time, the concentration of hypochlorous acid produced in the electrolytic cell unit 450 can be increased by decreasing the flow rate of water supplied to the electrolytic cell unit 450.

However, if the concentration of hypochlorous acid produced in the electrolytic cell unit 450 is increased to efficiently sterilize the nozzle 473, the force of cleaning away dirt and dirty water attached to the nozzle 473, i.e., the force of removing dirt and dirty water from the nozzle 473, may be insufficient. In other words, if the flow rate of water supplied to the electrolytic cell unit 450 is decreased, the concentration of hypochlorous acid can indeed be increased. However, the force of removing dirt and dirty water from the nozzle 473 may be insufficient.

This problem is often more significant in the case where the nozzle unit includes multiple water discharge ports or water discharge portions. More specifically, the nozzle unit 470 of this embodiment includes a water discharge port 474 connected to the first flow channel 21 and a water discharge portion 479 connected to the second flow channel 22. Thus, when the controller 405 controls the flow channel switching valve 472 to guide the sterilizing water produced in the electrolytic cell unit 450 to both the first flow channel 21 and the second flow channel 22, the force (water force) of removing dirt and dirty water from the nozzle 473 may be more insufficient. In other words, in the case where the nozzle unit includes multiple water discharge ports or water discharge portions, if the controller passes the sterilizing water to all the flow channels, the force of removing dirt and dirty water from the nozzle may be insufficient.

In this context, in the sanitary washing device 100 according to this embodiment, in the case where the controller 405 controls the flow rate switching valve 471 to make the flow rate of water supplied to the electrolytic cell unit 450 lower than the maximum flow rate when producing sterilizing water, the controller 405 can control the flow channel switching valve 472 to pass the sterilizing water through only one of the first flow channel 21 and the second flow channel 22. Here, the "maximum flow rate" used herein refers to the maximum of the flow rate of water which can flow in the water conduit 20 or the first flow channel 21 or the second flow channel 22 during the operation of the sanitary washing device 100. Hence, the controller 405 can ensure the force (water force) of removing dirt and dirty water from the nozzle while ensuring the concentration of hypochlorous acid by decreasing the flow rate of water supplied to the electrolytic cell unit 450. Thus, the nozzle 473 can be sterilized more efficiently. Furthermore, the cleanliness of the nozzle 473 as viewed from the user can be improved.

Furthermore, in the sanitary washing device 100 according to this embodiment, in the case where the controller 405 controls the flow rate switching valve 471 to make the flow rate of water supplied to the electrolytic cell unit 450 lower than the maximum flow rate when producing sterilizing water, the controller 405 controls the pressure modulator 460 to vary the flow state of water flowing in the water conduit 20. Hence, an unsteady flow occurs on the surface of the nozzle 473, inside the water conduit 20, and inside the first and second flow channels 21 and 22. Thus, the force of removing dirt and bacteria present on the surface of the nozzle 473, the inner wall of the water conduit 20, and the inner wall of the first and second flow channels 21 and 22 is made higher than in the case of no variation in the flow state of water. Thereby, the flow velocity and flow rate of water required to remove dirt and dirty water from the nozzle 473 can be ensured while ensuring the concentration of sterilizing water. In other words, the nozzle 473 can be sterilized more efficiently. Here, the scope of the term "sterilizing the nozzle 473" used herein encompasses not only sterilizing the surface of the nozzle 473, but also sterilizing the inside of the water conduit 20 and the first and second flow channels 21 and 22 provided inside the nozzle 473. Here, despite decreasing the flow rate of water supplied to the electrolytic cell unit 450 to increase the concentration of hypochlorous acid, the controller 405 ensures the flow velocity and flow rate of water by controlling the pressure modulator 460. However, this causes little problem.

This is because the increased amount of flow rate (e.g., approximately 20 ml/min) ensured in the pressure modulator is small with respect to the decreased amount of flow rate (e.g., approximately 150 ml/min) to increase the concentration of hypochlorous acid. Hence, ensuring the flow rate by the controller 405 controlling the pressure modulator does not significantly affect the increase in the concentration of hypochlorous acid. According to this, the controller 405 can ensure the force (water force) of removing dirt and dirty water from the nozzle while ensuring the concentration of hypochlorous acid by decreasing the flow rate of water supplied to the electrolytic cell unit 450.

Furthermore, in the sanitary washing device 100 according to this embodiment, in the case where the controller 405 controls the flow rate switching valve 471 to make the flow rate of water supplied to the electrolytic cell unit 450 lower than the maximum flow rate when producing sterilizing water, the controller 405 can control the hot water heater 441 of the heat exchanger unit 440 to heat the water supplied to the electrolytic cell unit 450. In other words, the controller 405 can supply hot water to the electrolytic cell unit 450. According to this, because the electrolysis efficiency in the electrolytic cell unit 450 increases, the electrolytic cell unit 450 can further increase the concentration of hypochlorous acid. This is one of the effective methods for increasing the concentration of hypochlorous acid in a geographical area where the concentration of chlorine ions in tap water is low. Here, this is not limited to the case where the controller 405 makes the flow rate of water supplied to the electrolytic cell unit 450 lower than the maximum flow rate when producing sterilizing water. Also in the case of the maximum flow rate, the controller 405 can control the hot water heater 441 to heat the water supplied to the electrolytic cell unit 450. According to this, the cleaning power of the sterilizing water can be further improved.

Furthermore, in the sanitary washing device 100 according to this embodiment, the controller 405 can control the air bubble injecting part 490 to inject air into the sterilizing water to produce air bubbles in the sterilizing water. This increases the apparent flow rate of the sterilizing water mixed with air. Hence, the flow velocity and flow rate of water required to remove dirt and dirty water from the nozzle 473 can be ensured. Thereby, the force of removing dirt and bacteria present on the surface of the nozzle 473, the inner wall of the water conduit 20, and the inner wall of the first and second flow channels 21 and 22 can be ensured.

Furthermore, in the sanitary washing device 100 according to this embodiment, in the case where the concentration of chlorine ions detected by the ion concentration detecting part 480 is equal to or lower than a prescribed concentration, the controller 405 controls the flow rate switching valve 471 to make the flow rate of water supplied to the electrolytic cell unit 450 lower than the maximum flow rate. In the state in which the flow rate of water supplied to the electrolytic cell unit 450 is lower than the maximum flow rate, the controller 405 produces sterilizing water in the electrolytic cell unit 450.

For example, when hypochlorous acid is produced in the electrolytic cell unit 450, the concentration of chlorine ions in tap water used as a raw material is one of the important factors. Hence, the controller 405 can increase the concentration of hypochlorous acid more efficiently by determining the timing of increasing the concentration of hypochlorous acid based on the concentration of chlorine ions in the water flowing into the electrolytic cell unit 450.

The above description with reference to FIG. 4 to FIG. 7 takes as an example of the case where the electrolytic cell unit 450 produces a solution containing hypochlorous acid as sterilizing water. However, the sterilizing water produced in the electrolytic cell unit 450 is not limited thereto. The sterilizing water produced in the electrolytic cell unit 450 may be, for example, a solution containing metal ions such as silver ions and copper ions. Alternatively, the sterilizing water produced in the electrolytic cell unit 450 may be a solution containing electrolytic chlorine, ozone, etc. Alternatively, the sterilizing water produced in the electrolytic cell unit 450 may be acid water or alkaline water. These cases are also encompassed within the scope of the invention as long as they include the features of the invention. In the following, for convenience of description, the case where the sterilizing water is a solution containing hypochlorous acid is taken as an example.

Figure 8:
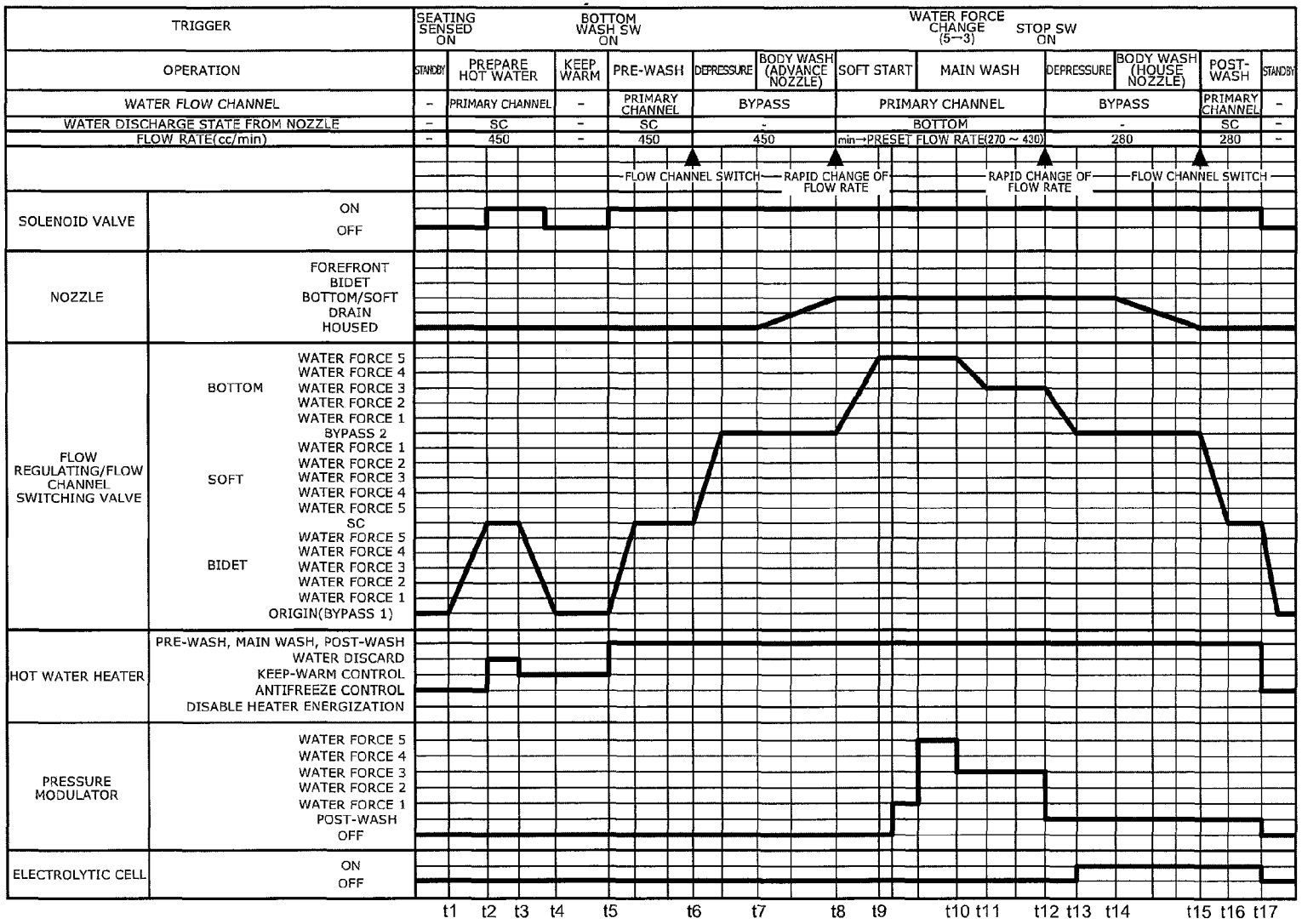
FIG. 8 is a timing chart illustrating an example operation of the sanitary washing device according to the embodiment.

FIG. 8 is a timing chart illustrating an example operation of the sanitary washing device according to this embodiment.

First, when the seating sensor 404 senses a user seated on the toilet seat 200 (timing n), the controller 405 switches the flow channel switching valve 472 from "origin" to "SC (self-cleaning)" to enable water discharge from the water discharge port 474 through all the first flow channels 21 for "bottom wash" and "bidet wash". The flow rate (volume of water) at this time is, for example, approximately 450 cc/min, and is set to the maximum flow rate.

Subsequently, when the switching of the flow channel switching valve 472 is completed (timing t2), the controller 405 opens the solenoid valve 431 and sets the hot water heater 441 to the "water discard mode". Thereby, cold water in the first flow channel 21 is drained for preparation of hot water. Then, the controller 405 changes the setting of the hot water heater 441 from the "water discard mode" to the "keep-warm control mode", and then closes the solenoid valve 431 (timings t3 to t4). This is because the hot water heater 441 generates residual heat even after being set to "OFF". In other words, the controller 405 closes the solenoid valve 431 after changing the setting of the hot water heater 441 because of the so-called "after-boiling prevention".

Subsequently, when the user pushes a not-illustrated "bottom wash switch" provided on the manipulator 500 (timing t5), the controller 405 switches the flow channel switching valve 472 from "origin" to "SC", opens the solenoid valve 431, and sets the hot water heater 441 to the "pre-wash mode, main wash mode, post-wash mode". Thereby, the nozzle 473 is pre-washed. Subsequently, the controller 405 switches the flow channel switching valve 472 from "SC" to "bypass 2" so that water can be squirted from the water discharge portion 479 provided in the nozzle cleaning chamber 478 (timing t6).

Subsequently, the controller 405 advances the nozzle 473 housed in the casing 400 to the position of "bottom wash" (timings t7 to t8). At this time, because the controller 405 has opened the solenoid valve 431, the body of the nozzle 473 is cleaned with water squirted from the water discharge portion 479.

Subsequently, the controller 405 switches the flow channel switching valve 472 from "bypass 2" to "bottom water force 5" and starts main wash (bottom wash) (timings t8 to t10). Here, for example, if the user changes the setting of the water force in "bottom wash" from "water force 5" to "water force 3" by the manipulator 500, then the controller 405 switches the flow rate switching valve 471 from "bottom water force 5" to "bottom water force 3" (timings t10 to t11). Then, the controller 405 continues main wash at "water force 3" (timings t11 to t12).

In the above operation during timings t1 to t12, the controller 405 does not energize the electrolytic cell unit 450 and does not produce sterilizing water. Hence, in the pre-wash (timings t5 to t6) and body wash (timings t7 to t8), the nozzle 473 is physically cleaned with water. The flow rate (volume of water) at these timings is, for example, approximately 450 cc/min, and is set to the maximum flow rate. In "bottom wash" (timings t8 to t12), the "bottom" of the user seated on the toilet seat 200 is washed with water squirted from the water discharge port 474 of the nozzle 473.

When the user pushes a not-illustrated "stop switch" on the manipulator 500, the controller 405 switches the flow channel switching valve 472 from "bottom water force 3" to "bypass 2" so that water can be squirted from the water discharge portion 479 provided in the nozzle cleaning chamber 478 (timing t12). Furthermore, the controller 405 sets the pressure modulator 460 to the "post-wash mode" (timing t12). Subsequently, when the switching of the flow channel switching valve 472 is completed (timing t13), the controller 405 starts energization of the electrolytic cell unit 450 to start producing sterilizing water (timing t13). Subsequently, the controller 405 houses the nozzle 473 advanced to the position of "bottom wash" into the casing 400 (timings t14 to t15). Thereby, the body of the nozzle 473 is sterilized with sterilizing water squirted from the water discharge portion 479.

The flow rate (volume of water) at this time is, for example, approximately 280 cc/min. That is, the flow rate at this time is lower than the maximum flow rate (e.g., approximately 450 cc/min). Hence, the concentration of hypochlorous acid in the sterilizing water produced in the electrolytic cell unit 450 can be made higher than in the case of supplying water to the electrolytic cell unit 450 at the maximum flow rate. Furthermore, at this time, the controller 405 has set the flow channel switching valve 472 to "bypass 2", so that the sterilizing water can be squirted only from the water discharge portion 479 provided in the nozzle cleaning chamber 478. In other words, the controller 405 controls the flow channel switching valve 472 so that the sterilizing water produced in the electrolytic cell unit 450 is passed only through the second flow channel 22. Furthermore, the controller 405 sets the pressure modulator 460 to the "post-wash mode" to vary the flow state of water flowing in the water conduit 20.

Subsequently, in a state in which the nozzle 473 is housed in the casing 400, the controller 405 switches the flow channel switching valve 472 from "bypass 2" to "SC" (timing t15) to perform post-wash by discharging sterilizing water from the water discharge port 474 through all the first flow channels 21 for "bottom wash" and "bidet wash" (timings t16 to t17). The flow rate (volume of water) at this time is, for example, approximately 280 cc/min similar to that of the operation during timings t12 to t15. That is, the flow rate at this time is lower than the maximum flow rate (e.g., approximately 450 cc/min). Hence, the concentration of hypochlorous acid in the sterilizing water produced in the electrolytic cell unit 450 can be made higher than in the case of supplying water to the electrolytic cell unit 450 at the maximum flow rate.

Furthermore, at this time, the controller 405 has set the flow channel switching valve 472 to "SC", so that the sterilizing water can be squirted only from the water discharge port 474 of the nozzle 473. In other words, the controller 405 controls the flow channel switching valve 472 so that the sterilizing water produced in the electrolytic cell unit 450 is passed only through the first flow channel 21. Furthermore, at this time as well, the controller 405 maintains the pressure modulator 460 in the "post-wash mode" to vary the flow state of water flowing in the water conduit 20.

Thus, when the controller 405 energizes the electrolytic cell unit 450 to produce sterilizing water, the flow rate of water supplied to the electrolytic cell unit 450 is made lower than the maximum flow rate to increase the concentration of hypochlorous acid. Furthermore, as in the operation shown at timings t13 to t15 or timings t16 to t17, the controller 405 controls the flow channel switching valve 472 so that the sterilizing water produced in the electrolytic cell unit 450 is passed through only one of the first flow channel 21 and the second flow channel. Hence, the controller 405 can ensure the force (water force) of removing dirt and dirty water from the nozzle while ensuring the concentration of hypochlorous acid by making the flow rate of water supplied to the electrolytic cell unit 450 lower than the maximum flow rate. Thus, the nozzle 473 can be sterilized more efficiently. Furthermore, the cleanliness of the nozzle 473 as viewed from the user can be improved.

Furthermore, when energizing the electrolytic cell unit 450 to produce sterilizing water, the controller 405 sets the pressure modulator 460 to the "post-wash mode". Hence, the controller 405 can provide pulsation to the sterilizing water discharged from the water discharge port 474 of the nozzle 473 and the water discharge portion 479 of the nozzle cleaning chamber 478 to modulate the pressure of the sterilizing water. Thereby, the controller 405 can ensure the flow velocity and flow rate of water required to remove dirt and dirty water from the nozzle 473 while ensuring the concentration of hypochlorous acid by making the flow rate of water supplied to the electrolytic cell unit 450 lower than the maximum flow rate.

Furthermore, when energizing the electrolytic cell unit 450 to produce sterilizing water, the controller 405 sets the hot water heater 441 to the "pre-wash mode, main wash mode, post-wash mode". The preset temperature in the "pre-wash mode, main wash mode, post-wash mode" is higher than the preset temperature in the "antifreeze control mode" and "keep-warm control mode", which are set for standby time and keep-warm time, respectively. Hence, the controller 405 can control the hot water heater 441 to supply hot water with higher temperature to the electrolytic cell unit 450. Thereby, the electrolytic cell unit 450 can further increase the concentration of hypochlorous acid.

Subsequently, the controller 405 closes the solenoid valve 431 and switches the flow channel switching valve 472 from "SC" to "origin" (timing t17). Furthermore, the controller 405 sets the hot water heater 441 to the "antifreeze control mode", sets the pressure modulator 460 to "OFF", and stops energization of the electrolytic cell unit 450 (timing t17).

As described above, according to this embodiment, in the case where the controller 405 controls the flow rate switching valve 471 to make the flow rate of water supplied to the electrolytic cell unit 450 lower than the maximum flow rate when producing sterilizing water, the controller 405 controls the pressure modulator 460 to vary the flow state of water flowing in the water conduit 20. Furthermore, in the case where the controller 405 controls the flow rate switching valve 471 to make the flow rate of water supplied to the electrolytic cell unit 450 lower than the maximum flow rate when producing sterilizing water, the controller 405 can control the flow channel switching valve 472 to pass the sterilizing water through only one of the first flow channel 21 and the second flow channel 22. According to this, the controller 405 can ensure the force (water force) of removing dirt and dirty water from the nozzle while ensuring the concentration of hypochlorous acid by making the flow rate of water supplied to the electrolytic cell unit 450 lower than the maximum flow rate. Thus, the nozzle 473 can be sterilized more efficiently.

Hereinabove, the embodiments of the invention are described. However, the invention is not limited to the above description. Those skilled in the art can suitably modify the above embodiments, and such modifications are also encompassed within the scope of the invention as long as they include the features of the invention. For example, the shape, dimension, material, and layout of various components in the sanitary washing device 100, and the arrangement of the nozzle 473, the nozzle cleaning chamber 478, and the first and second flow channels 21 and 22 are not limited to those illustrated, but can be suitably modified.

Furthermore, various components in the above embodiments can be combined with each other as long as technically feasible. Such combinations are also encompassed within the scope of the invention as long as they include the features of the invention.

The invention claimed is:

1. A sanitary washing device comprising:

a nozzle including a water discharge port and configured to squirt water from the water discharge port to wash a human private part;

a water conduit configured to guide water supplied from a water supply source to the nozzle;

a sterilizing water supply part provided midway along the water conduit and configured to produce sterilizing water;

a flow rate adjusting part configured to adjust flow rate of water flowing in the sterilizing water supply part;

a flow state varying part configured to vary flow state of water flowing in the water conduit; and a controller configured to control the flow state varying part to vary the flow state of the water flowing in the water conduit when producing the sterilizing water by the sterilizing water supply part at the flow rate controlled by the controller, the controller controlling the flow rate adjusting part to make the flow rate of the water flowing in the sterilizing water supply part lower than a flow rate when washing the nozzle by the water.

2. The device according to claim 1, further comprising:

a first flow channel configured to guide the water supplied from the water supply source to the water discharge port of the nozzle;

a second flow channel configured to guide the water supplied from the water supply source to a surface of the nozzle; and a flow channel switching part configured to switch between a state in which the water supplied from the water supply source is passed through the first flow channel and a state in which the water supplied from the water supply source is passed through the second flow channel, the controller controlling the flow channel switching part to pass the sterilizing water through only one of the first flow channel and the second flow channel.

3. The device according to claim 1, wherein the flow state varying part is a pressure modulator provided downstream of the sterilizing water supply part and configured to provide pulsation or acceleration to the flow of the water.

4. The device according to claim 1, wherein the sterilizing water supply part is an electrolytic cell.

5. The device according to claim 4, further comprising:

an ion concentration detecting part configured to detect concentration of chlorine ions in the water flowing into the electrolytic cell, in the case where the concentration of the chlorine ions detected by the ion concentration detecting part is equal to or lower than a prescribed concentration, the sterilizing water being produced in the electrolytic cell at the flow rate controlled by the controller, the controller controlling the flow rate adjusting part to make the flow rate of the water flowing in the electrolytic cell lower than a flow rate when washing the nozzle by the water.

6. The device according to claim 1, further comprising:

a heating part provided upstream of the sterilizing water supply part and configured to heat the water supplied from the water supply source, the controller controlling the heating part to heat the water when producing the sterilizing water by the sterilizing water supply part.

7. The device according to claim 1, further comprising:

an air bubble injecting part provided downstream of the sterilizing water supply part and configured to inject air into the sterilizing water to produce air bubbles.

* * * * *

UNITED STATES PATENT AND TRADEMARK OFFICE

CERTIFICATE OF CORRECTION

PATENT NO. : 8,256,039 B2
APPLICATION NO. : 12/850004
DATED : September 4, 2012
INVENTOR(S) : Yo Morotomi et al.

It is certified that error appears in the above-identified patent and that said Letters Patent is hereby corrected as shown below:

Column 13, line 7, replace "(timing n)" with -- (timing t1) --

Signed and Sealed this
Twenty-seventh Day of November, 2012

David J. Kappos

David J. Kappos
*Director of the United States Patent and Trademark Office*